US006607290B2

(12) United States Patent
Matsuba et al.

(10) Patent No.: US 6,607,290 B2
(45) Date of Patent: Aug. 19, 2003

(54) TUBULAR LIGHT BULB DEVICE

(75) Inventors: Tetsuo Matsuba, Neyagawa (JP); Makoto Inoue, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 108 days.

(21) Appl. No.: 09/941,066

(22) Filed: Aug. 28, 2001

(65) Prior Publication Data

US 2002/0024814 A1 Feb. 28, 2002

(30) Foreign Application Priority Data

Aug. 30, 2000 (JP) ..... 2000-260414

(51) Int. Cl.[7] ..... F21V 29/00

(52) U.S. Cl. ..... 362/294; 362/216; 362/260; 362/373; 362/264

(58) Field of Search ..... 362/216, 260, 362/294, 373, 264

(56) References Cited

U.S. PATENT DOCUMENTS 4,363,083 A * 12/1982 Tanaka et al. ..... 362/216
5,720,548 A * 2/1998 Geary ..... 362/260
6,204,602 B1 * 3/2001 Yang et al. ..... 362/294

* cited by examiner

*Primary Examiner*—Stephen Husar
(74) *Attorney, Agent, or Firm*—Rosenthal & Osha L.L.P.

(57) ABSTRACT

A tubular light bulb device includes an arc tube, a lighting circuit for lighting the arc tube, a case housing the lighting circuit and having a base at one end, and a heat-transferring member disposed in the case for conducting heat from a space formed in the case to the base. This allows the tubular light bulb device to discharge heat in the space formed in the case to the outside to reduce temperature of a phosphor film and electronic parts of the lighting circuit, whereby increased life can be obtained.

16 Claims, 6 Drawing Sheets

TUBULAR LIGHT BULB DEVICE

BACKGROUND OF THE INVENTION

1. Field of the Invention

The present invention relates generally to a tubular light bulb device. More specifically, the present invention relates to a tubular light bulb device where a fluorescent lamp and a lighting circuit are provided in a case and a globe.

2. Related Background Art

Conventional tubular light bulb devices include a bulb-type fluorescent lamp. As shown in FIG. 6, a bulb-type fluorescent lamp includes an envelope 3 composed of a globe 1 and a resin case 2, where a fluorescent tube 4, a lighting circuit 5 for lighting the fluorescent tube 4, and a base 7 of, for example, the E26 type, attached to one end of the case 2 are provided. The lighting circuit 5 is housed in the case 2. Further, the lighting circuit 5 includes a circuit board 5*a* and electronic parts 5*b* mounted on the circuit board 5*a*.

However, the conventional bulb-type fluorescent lamp structure is not ideal for dissipating heat. The fluorescent tube 4 and the lighting circuit 5 both generate heat. Due to the sealed structure of the case 2, heat permeates a space formed in the case 2. As a result, the electronic parts 5*b* used in the lighting circuit 5 and even a phosphor film (not shown) applied to an inner face of the fluorescent tube 4 may be damaged by heat, thus decreasing lamp life.

SUMMARY OF THE INVENTION

The invention provides a tubular light bulb device that discharges heat in a space formed in a case to the outside to reduce temperature, thereby increasing bulb life.

In some embodiments, a tubular light bulb device of the invention includes an arc tube, a lighting circuit for lighting the arc tube, and a case housing the lighting circuit and having a base at one end, and a heat-transferring member disposed in the case for conducting heat from a space formed in the case to the base.

DETAILED DESCRIPTION OF THE INVENTION

According to a tubular light bulb device of the present invention, heat generated from a fluorescent tube and a lighting circuit can be conducted to a base and further to a lampholder into which the base is fit and thus discharged to the outside. Therefore, the heat generated from the fluorescent tube and the lighting circuit does not permeate the space formed in the case, and thus heat damage to the phosphor film and electronic parts of the lighting circuit can be avoided.

The heat-transferring member may be connected to the base and composed of a member embedded in the case. In some embodiments, at least a portion of the heat-transferring member may be exposed to the space formed in the case. The heat-transferring member may be connected to the base and provided on an inner face of the case. The heat-transferring member may extend from one end to the other end of the case. Additionally, the heat-transferring member may be connected to the base in such a manner that an end of the heat-transferring member is overlapped with an end of the base. The heat-transferring member may be provided with through-holes, and may be insulated electrically from the base. The electrically-insulating member may be made of at least one selected from the group consisting of titanium oxide, alumina, silicon oxide, and fluorocarbon resin formed on a surface of the heat-transferring member. The heat-transferring member also may be integrated with a portion of the base.

The heat-transferring member may be formed of at least one material selected from the group consisting of metal, resin, and ceramic.

In some embodiments, the heat-transferring member may be made of metal and a portion thereof adjacent to a part in the lighting circuit that generates magnetism may be cut away. The heat-transferring member may be formed of a case integrated with a metal plate embedded in resin as a forming material. The metal plate embedded in the resin may be provided, on a side of the base, with through-holes penetrating from inside to outside. The heat-transferring member may be formed of a metal plate having a thickness in the range of 0.05 mm to 0.3 mm. A contact area between the heat-transferring member and the base may be at least 300 $mm^2$.

Hereinafter, the present invention will be described by way of embodiments with reference to the appended drawings.

Embodiment 1

Figure 1:
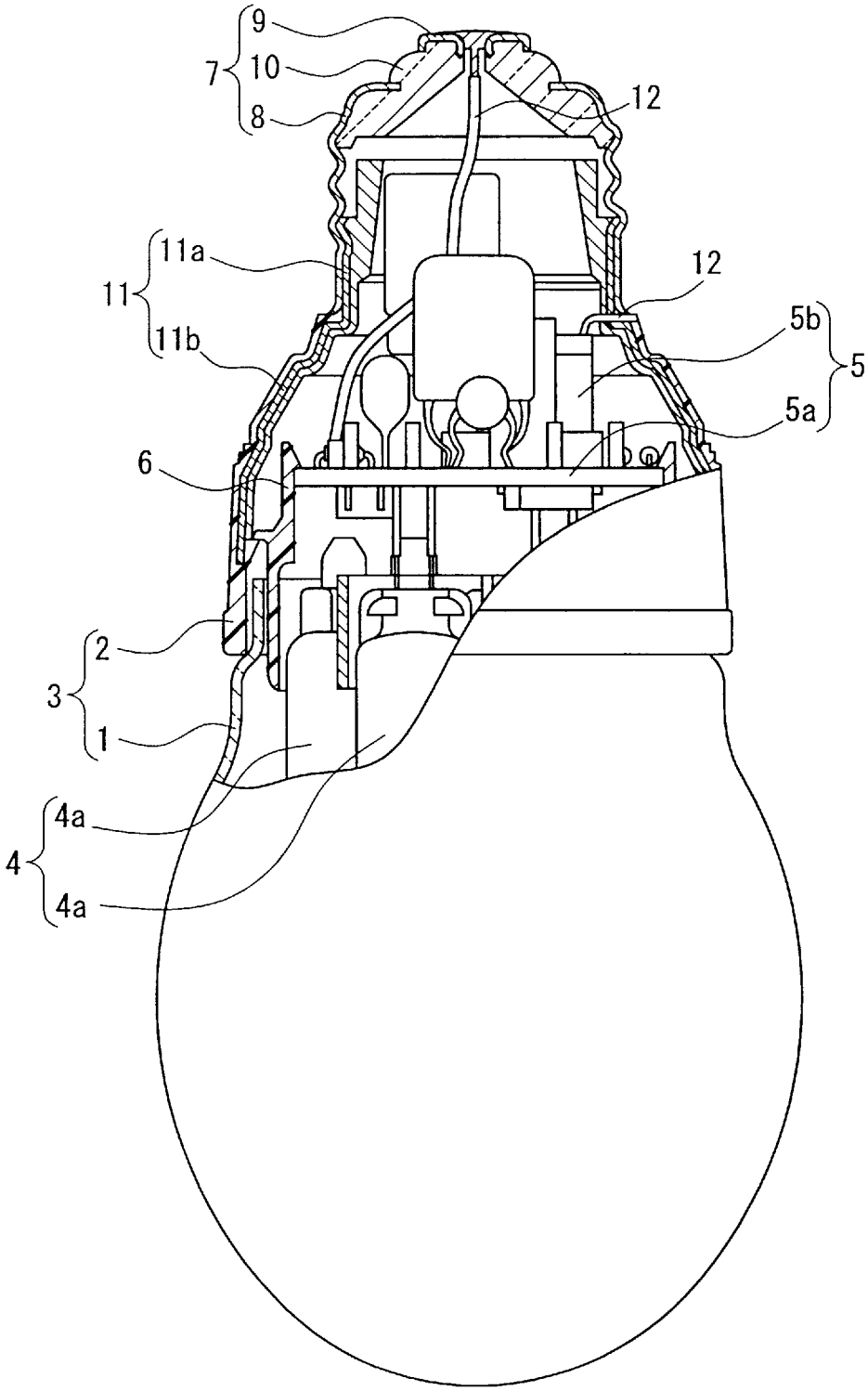
FIG. 1 is a partially cut-away front view of a bulb-type fluorescent lamp of Embodiment 1 according to the present invention.

A bulb-type fluorescent lamp having a rated power of 13 W of Embodiment 1 according to the present invention is 120 mm in full length and 60 mm in maximum outer diameter. As shown in FIG. 1, the bulb-type fluorescent lamp of Embodiment 1 according to the present invention is formed of an envelope 3 composed of a globe 1 made of glass or resin having transparency and a case 2 made of resin such as polybutylene terephthalate (PBT). The envelope 3 houses a fluorescent tube 4 in which three U-shaped tubes 4*a* (only two of them are shown) each having an outer diameter of 11 mm, are bridge-connected to form one discharging path, a lighting circuit 5 for lighting the fluorescent tube 4, and a holder 6 holding one end of the fluorescent tube 4 on one face and the lighting circuit 5 on the other face opposed to the fluorescent tube 4. The lighting circuit 5 is housed in the case 2.

The case 2 is in substantially a funnel shape having a full length of 45.5 mm and outer diameters of 21 mm at one end and 47 mm at the other end. Further, a base 7 of, for example, the E26 type is attached to the one end of the case 2. The base 7 includes a shell 8, an eyelet 9, and insulating glass 10 interposed between the shell 8 and the eyelet 9. The shell 8 and the eyelet 9 are composed of phosphor bronze, brass, iron, stainless steel, nickel, or the like, and surfaces thereof are plated with tin, zinc, nickel, or the like to prevent rusting.

Furthermore, the case 2 is provided with a unit for conducting heat in a space formed in the case 2 to the base 7.

The heat-conducting unit extends from one end to the other end of the case 2 so as to cover an entire periphery of the space formed in the case 2. Also, the heat-conducting unit is composed of a heat-transferring member 11 made of metal (such as copper, iron, aluminum, or an alloy of these materials) and having a plate shape with a thickness of 0.05 mm to 0.3 mm, which is connected thermally to the shell 8 in such a manner that one end of the heat-transferring member 11 is overlapped with an inner face of an end of the shell 8 of the base 7. In an example shown in FIG. 1, a contact area between the shell 8 and the heat-transferring member 11 is 800 $mm^2$. In order for heat absorbed by the heat-transferring member 11 to be conducted efficiently to the shell 8, the contact area between the shell 8 and the heat-transferring member 11 only needs to be at least 300 $mm^2$. Further, the heat-transferring member 11 is positioned on an outer face of the case 2 on one end (a portion 11*a* connected thermally to the shell 8) and embedded in the case 2, namely, in resin as a member of the case 2 on a portion 11*b* excluding the portion 11*a*.

Furthermore, preferably, the shell 8 and the heat-transferring member 11 are electrically insulated, for example, by forming an insulating film (not shown) of titanium oxide, alumina, silicon oxide, fluorocarbon resin, or the like on a surface of the portion 11*a* of the heat-transferring member 11 that is in contact with the shell 8. This can improve dielectric withstanding voltage between an inner face of the case 2 and the shell 8 and in addition, prevent a potential of the shell 8 from being applied to electronic parts 5*b* of the lighting circuit 5 (described later), whereby reliability in terms of safety, prevention against damage to the electronic parts 5*b*, or the like can be improved.

Moreover, although not shown in the figure, when the electronic parts 5*b* of the lighting circuit 5 (described later) employs a part generating magnetism such as a transformer (not shown), there is a possibility of heat generation by eddy current generated in a portion of the heat-transferring member 11, through which particularly strong lines of magnetic force from the transformer passes, namely, the portion adjacent to the transformer. Because of this, preferably, the portion of the heat-transferring member 11 that is adjacent to the transformer is cut away. Further, providing the heat-transferring member 11 made of metal particularly with a cut out portion or a cut away portion apart from the portion described above allows the case 2 to be reduced in weight.

The fluorescent tube 4 is provided with electrodes (not shown) at both ends. Further, in the fluorescent tube 4, predetermined amounts of mercury or mercury amalgam and rare gas are sealed, respectively. Moreover, on an inner face of the fluorescent tube 4, a phosphor film (not shown) of rare-earth phosphor, halo phosphoric acid phosphor, or the like is formed.

The lighting circuit 5 includes a circuit board 5*a* composed of paper-phenolic resin, glass epoxy resin, or the like and the electronic parts 5*b* (for example, power transistor, choke coil, capacitor, electrolytic capacitor, chip resistor, or the like) mounted on the circuit board 5*a*. Further, two lead wires 12 are connected to the lighting circuit 5. The lead wires 12 are connected to the shell 8 and the eyelet 9, respectively, by soldering or the like.

The following description pertains to evaluation for life characteristics that was performed with respect to the bulb-type fluorescent lamp as described above (hereinafter referred to as "a product A of the present invention").

For comparison, evaluation for life characteristics was performed also with respect to a bulb-type fluorescent lamp having a rated power of 13 W (hereinafter referred to as "a comparative product A") under the same condition as that of the product A of the present invention. The comparative product A has the same configuration as that of the bulb-type fluorescent lamp having a rated power of 13 W of Embodiment 1 according to the present invention except that a unit (namely, a heat-transferring member 11) for conducting heat in a space formed in a case 2 to a base 7 is not provided in the case 2.

The number of samples for each of the product A of the present invention and the comparative product A was ten.

As a result, the product A of the present invention proved to have a life of 6,600 to 7,000 hours, while the comparative product A proved to have a life of 6,000 hours. This result shows that the product A of the present invention has a life improved by 10 to 15% compared with that of the comparative product A.

It is believed that this is attributable to the following. As for the product A of the present invention, heat generated from the fluorescent tube 4 and the lighting circuit 5 (more specifically, the electronic parts 5*b* such as a power transistor or a capacitor) was conducted to the shell 8 of the base 7 via the heat-transferring member 11. The heat thus conducted was conducted from the shell 8 further to a lampholder (not shown) into which the base 7 was fit and thus discharged to the outside. Therefore, the heat generated from the fluorescent tube 4 and the lighting circuit 5 did not permeate the space formed in the case 2. As a result, the phosphor film and the electronic parts 5*b* of the lighting circuit 5 (more specifically, an electrolytic capacitor, a power transistor, or the like) could be prevented from being damaged by the heat.

On the other hand, as for the comparative product A, heat generated from a fluorescent tube 4 and a lighting circuit 5 permeated the space formed in the case 2 to elevate temperature in the space. Because of this, a phosphor film and the electronic parts 5*b* of the lighting circuit 5 were damaged by the heat.

As described above, the configuration of the bulb-type fluorescent lamp of Embodiment 1 according to the present invention allows the phosphor film and the electronic parts 5*b* of the lighting circuit 5 to be prevented from being damaged by heat, whereby increased life can be obtained.

Further, although not shown in the figure, exposing a part of the portion 11*b* of the heat-transferring member 11 that is embedded in the case 2 to the space formed in the case 2 allows the heat-transferring member 11 to absorb efficiently heat generated in the space formed in the case 2. Accordingly, the phosphor film and the electronic parts 5*b* of the lighting circuit 5 further can be prevented from being damaged by heat, whereby further increased life can be obtained.

Embodiment 2

Figure 2:
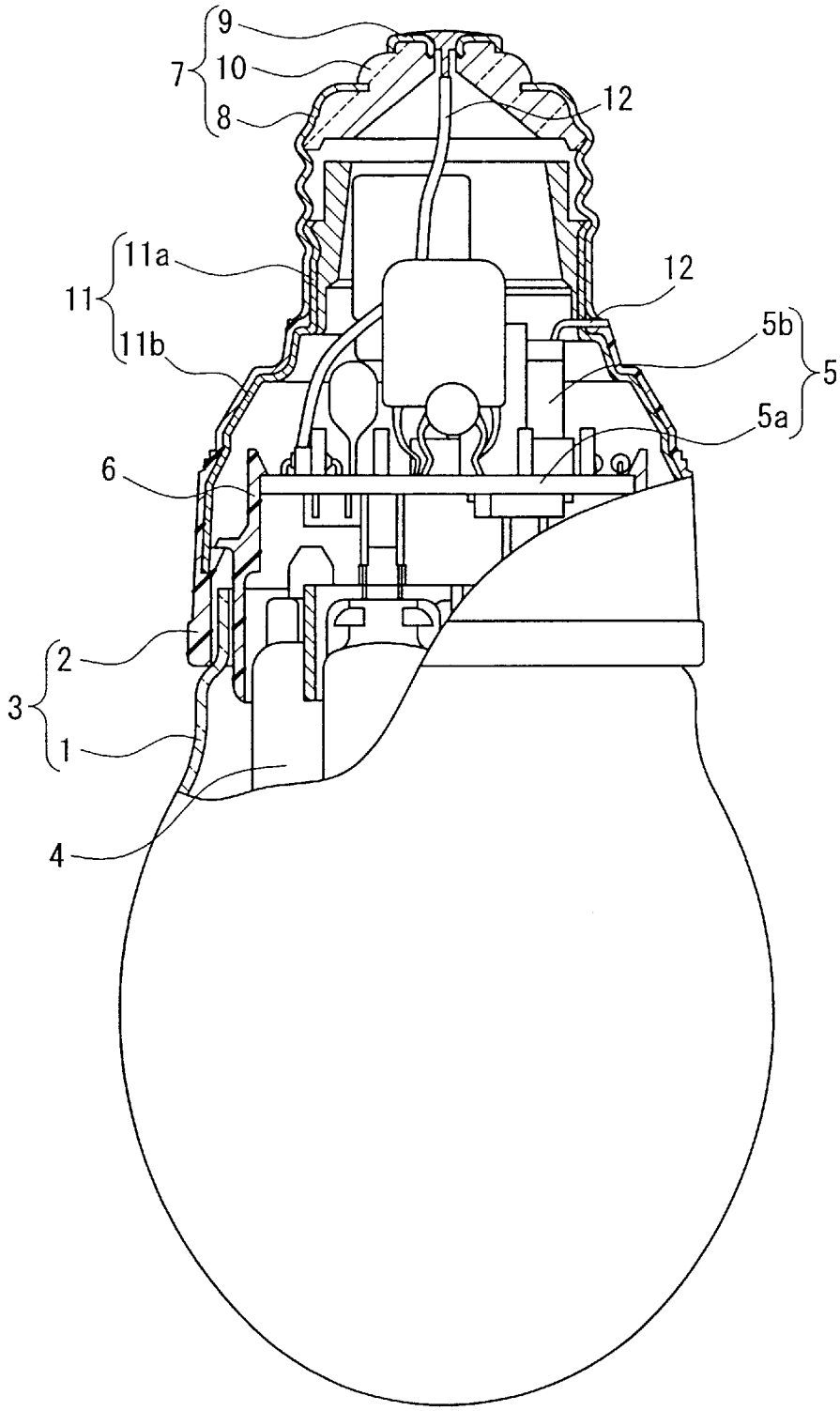
FIG. 2 is a partially cut-away front view of a bulb-type fluorescent lamp of Embodiment 2 according to the present invention.

The following description is directed to a bulb-type fluorescent lamp having a rated power of 13 W of Embodiment 2 according to the present invention. As shown in FIG. 2, the bulb-type fluorescent lamp of Embodiment 2 according to the present invention has the same configuration as that of the bulb-type fluorescent lamp having a rated power of 13 W of Embodiment 1 according to the present invention except that a portion of a unit for conducting heat in a space formed in a case 2 to a base 7, namely, a heat-transferring member 11 is not embedded in the case 2 but provided on an inner face of the case 2.

That is, a portion 11*b* of the heat-transferring member 11 excluding a portion 11*a* connected thermally to a shell 8 of the base 7 is provided on the inner face of the case 2.

A portion of the heat-transferring member 11 that is exposed to the space formed in the case 2 has an area of 2,100 $mm^2$.

The following description pertains to evaluation for life characteristics that was performed with respect to the bulb-type fluorescent lamp of Embodiment 2 according to the present invention as described above (hereinafter referred to as "a product B of the present invention").

The number of samples for the product B of the present invention was ten.

As a result, the product B of the present invention proved to have a life of 7,000 hours. This result shows that the product B of the present invention had a life improved by 15% compared to that of the comparative product A.

As described above, the configuration of the bulb-type fluorescent lamp of Embodiment 2 according to the present invention allows the following. Since the portion (the member 11*b*) of the heat-transferring member 11 is provided on the inner face of the case 2, the heat-transferring member 11 can absorb heat more efficiently that is generated in the space formed in the case 2. Accordingly, a phosphor film and electronic parts 5*b* of a lighting circuit 5 further can be prevented from being damaged by heat, whereby further increased life can be obtained.

Embodiment 3

Figure 3:
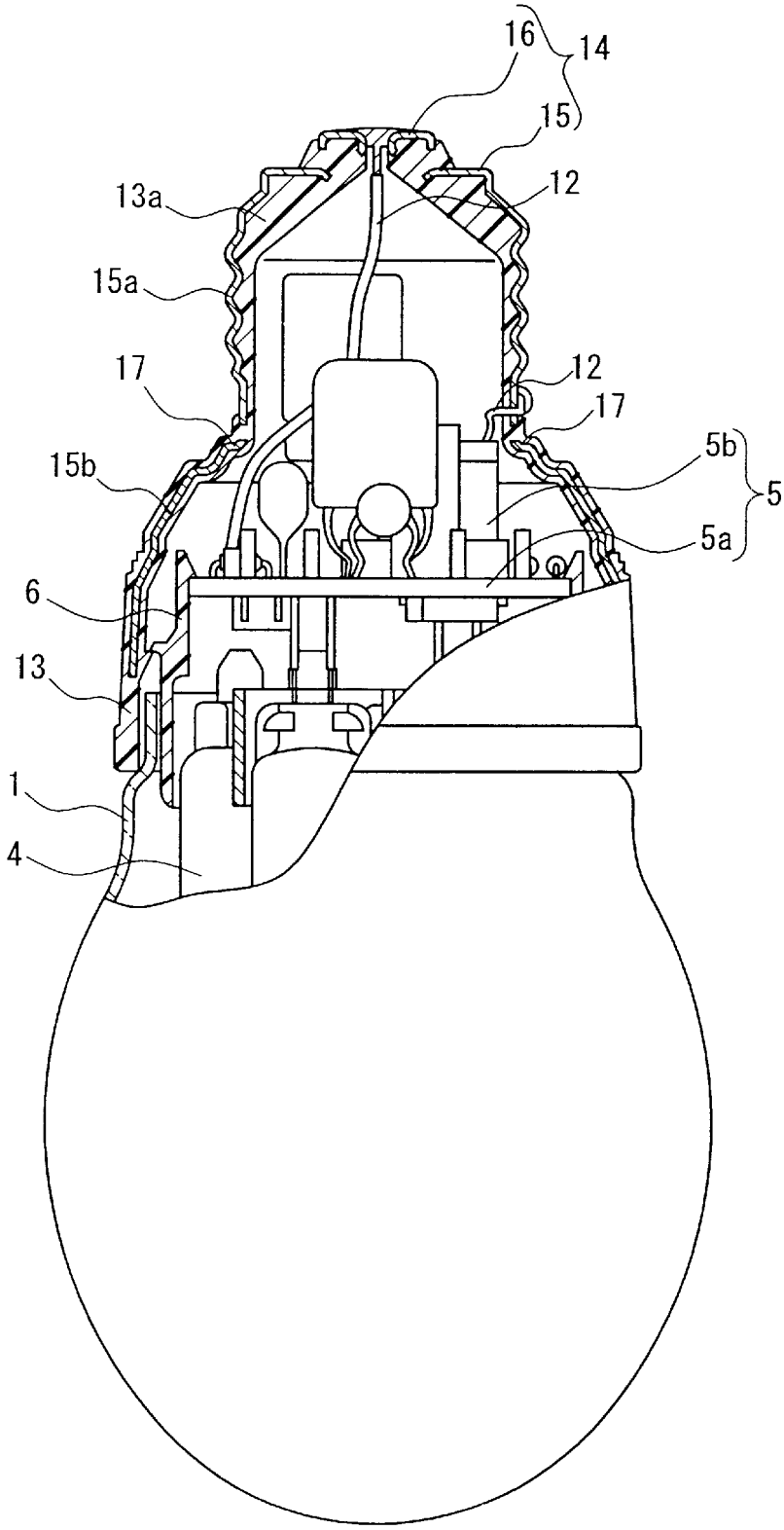
FIG. 3 is a partially cut-away front view of a bulb-type fluorescent lamp of Embodiment 3 according to the present invention.

The following description is directed to a bulb-type fluorescent lamp having a rated power of 13 W of Embodiment 3 according to the present invention. As shown in FIG. 3, the bulb-type fluorescent lamp of Embodiment 3 according to the present invention has the same configuration as that of the bulb-type fluorescent lamp having a rated power of 13 W of Embodiment 1 according to the present invention except that a case 13 and a base 14 (a shell 15 and an eyelet 16) are integrated and that a portion of the base 14 (a heat-transferring member 15*b* that will be described later) forms a unit for conducting heat in a space formed in the case 13 to the base 14 (a portion 15*a* of the shell 15 that will be described later).

At one end of the case 13, a cylindrical portion 13*a* to be fit into a lampholder (not shown), which is bottomed, 27 mm in length, and 26.4 mm in maximum outer diameter is formed.

On a side face of the cylindrical portion 13*a,* the shell 15 having a thickness of 0.1 to 0.2 mm where a thread is formed at one end (let a portion where the thread is formed be a portion 15*a*) is installed. On an outer face of a bottom of the cylindrical portion 13*a,* the eyelet 16 having a thickness of 0.20 mm is installed.

A portion of the case 13 is interposed between the shell 15 and the eyelet 16 to insulate them from each other. Further, the shell 15 and the eyelet 16 are made of the same material as that of the shell 8 and the eyelet 9 shown in FIG. 1.

The other end of the shell 15 extends to the other end of the case 13. The extending portion (a portion where the thread is not formed) is embedded in the case 13. That is, as described above, a portion of the shell 15 as the base 14 forms the member 15*b* as a unit for conducting heat in the space formed in the case 13 to the base 14 (the heat-transferring part 15*a* of the shell 15).

Furthermore, on the member 15*b,* a plurality of through-holes 17 having a diameter of 1 mm are provided. Functions of the through-holes 17 will be described later.

The following description is directed to a method of manufacturing the case 13 as described above.

Figure 4:
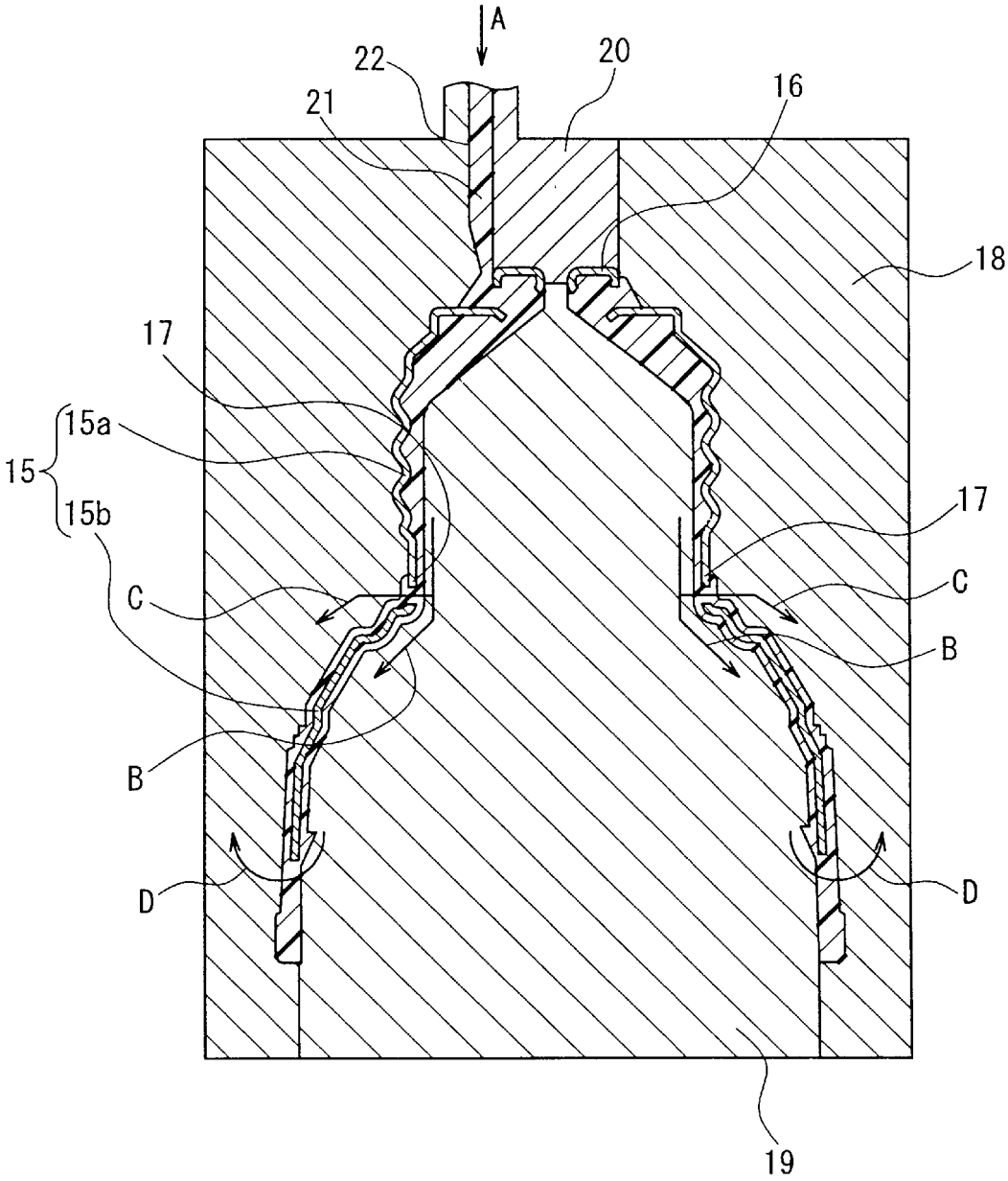
FIG. 4 is a schematic diagram showing a method of manufacturing a case used in the bulb-type fluorescent lamp of Embodiment 3.

As shown in FIG. 4, the case 13 is manufactured by pouring liquid resin 21 such as PBT as a material of the case 13 into a space formed by three molds, namely, a first mold 18, a second mold 19, and a third mold 20. This molding method is termed insert molding.

The first mold 18 is used for holding the shell 15 in a predetermined position and molding an outer shape of the case 13. The second mold 19 is used for molding an inner shape of the case 13. The third mold 20 is used for holding the eyelet 16 in a predetermined position. Further, a portion of a border between the first mold 18 and the third mold 20 is provided with a resin-pouring spout 22 for pouring the liquid resin 21 into a space formed by the first mold 18, the second mold 19, and the third mold 20.

First, the respective molds 18, 19, and 20 are assembled as shown in FIG. 4, and the shell 15 and the eyelet 16 are disposed in predetermined positions in the space (cavity) formed by the respective molds 18, 19, and 20.

Then, the liquid resin 21 is poured into the space formed by the respective molds 18, 19, and 20 (in FIG. 4, in a direction indicated by A). The liquid resin 21 initially flows into a clearance between the portion 15*a* of the shell 15 and the second mold 19. The liquid resin 21 subsequently flows into a clearance between the heat-transferring member 15*b* of the shell 15 and the second mold 19 (in FIG. 4, in directions indicated by B), passes through the through-holes 17, and flows into a clearance between the heat-transferring member 15*b* of the shell 15 and the first mold 18 (in FIG. 4, in directions indicated by C), respectively.

When the heat-transferring member 15*b* is not provided with the through-holes 17, after flowing into the clearance between the heat-transferring member 15*b* and the second mold 19, the liquid resin 21 flows into the clearance between the heat-transferring member 15*b* and the first mold 18 by going around an end of the heat-transferring member 15*b* (in FIG. 4, in directions indicated by D), thereby taking time to flow throughout the clearance. However, providing the heat-transferring member 15*b* with the through-holes 17 makes the liquid resin 21 flow mainly in the C directions. Therefore, the liquid resin 21 can flow throughout the space formed by the respective molds 18, 19, and 20 in a short time, whereby work efficiency can be improved.

After that, the liquid resin 21 that has been poured is solidified. Then, the respective molds 18, 19, and 20 are removed and thus, the case 13 integrated with the base 14 as shown in FIG. 3 is manufactured. The case 13 integrated by embedding the heat-transferring member 15*b* in the case 13 was formed in this manner.

The following description pertains to evaluation for life characteristics that was performed with respect to the bulb-type fluorescent lamp of Embodiment 3 according to the present invention as described above (hereinafter referred to as "a product C of the present invention").

The number of samples for the product C of the present invention was ten.

As a result, the product C of the present invention proved to have a life of 6,600 to 7,000 hours as in the product A of the present invention.

Consequently, as in the case of the bulb-type fluorescent lamp of Embodiment 1 according to the present invention, the configuration of the bulb-type fluorescent lamp of Embodiment 3 according to the present invention allows a phosphor film and electronic parts 5*b* of a lighting circuit 5 to be prevented from being damaged by heat, whereby increased life can be obtained.

Furthermore, the following also applies to the bulb-type fluorescent lamp of Embodiment 3 according to the present invention. Although not shown in the figure, providing the heat-transferring member 15*b* on an inner face of the case 13 as shown in FIG. 2 allows the heat-transferring member 15*b* to absorb efficiently heat generated in the space formed in the case 13. Accordingly, the phosphor film and the electronic parts 5*b* of the lighting circuit 5 further can be prevented from being damaged by heat, whereby further increased life can be obtained.

Embodiment 4

Figure 5:
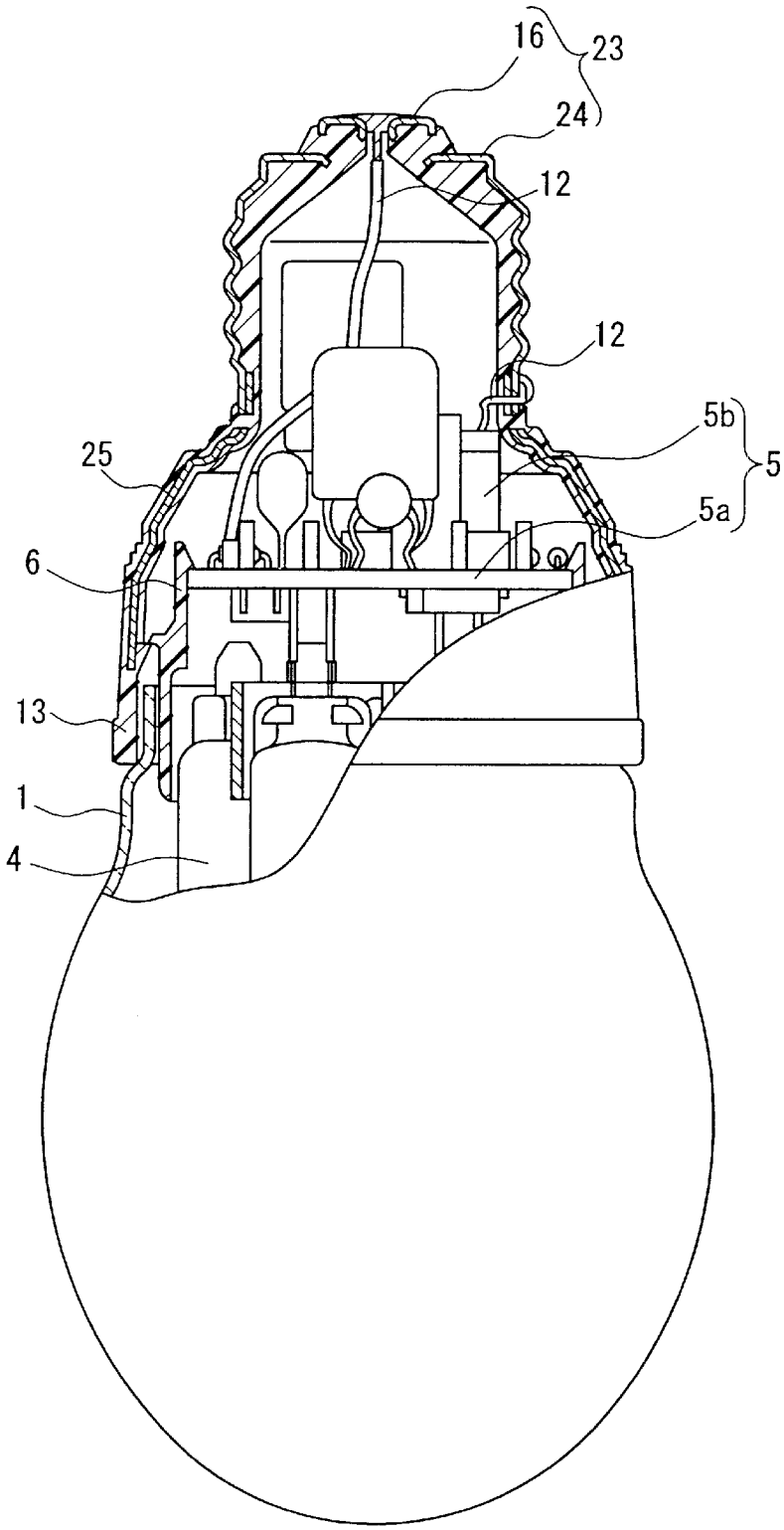
FIG. 5 is a partially cut-away front view of a bulb-type fluorescent lamp of Embodiment 4 according to the present invention.
Figure 6:
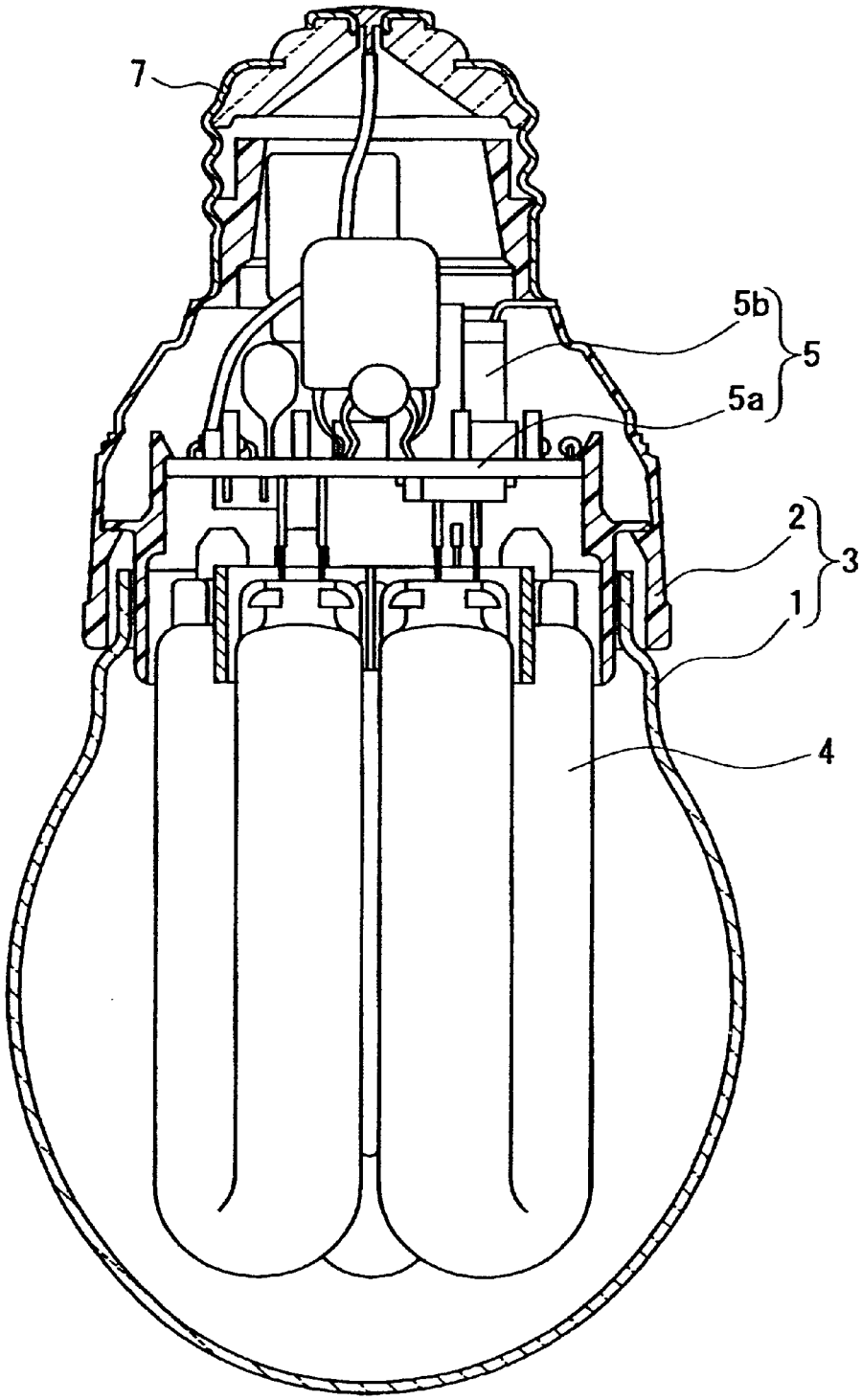
FIG. 6 PRIOR ART
FIG. 6 is a partially cut-away front view of a conventional bulb-type fluorescent lamp.

The following description is directed to a bulb-type fluorescent lamp having a rated power of 13 W of Embodiment 4 according to the present invention. As shown in FIG. 5, the bulb-type fluorescent lamp of Embodiment 4 according to the present invention has the same configuration as that of the bulb-type fluorescent lamp having a rated power of 13 W of Embodiment 3 according to the present invention where a case 13 and a base 23 are integrated except that a shell 24 of the base 23 and a unit for conducting heat in a space formed in the case 13 to the base 23, namely, a heat-transferring member 25 are composed of separate parts that are discontinuous.

The shell 24 and the heat-transferring member 25 are connected thermally in such a manner that ends of the shell 24 and the heat-transferring member 25 are overlapped with each other. A contact area between the shell 24 and the heat-transferring member 25 is 400 $mm^2$.

Furthermore, preferably, the member 25 has a plate shape having a thickness of 0.1 to 0.3 mm, and is made of a material different from that of the shell, which has an excellent thermal conductivity such as copper, iron, aluminum, an alloy of these materials, or the like.

As described above, the configuration of the bulb-type fluorescent lamp of Embodiment 4 according to the present invention allows a phosphor film and electronic parts 5*b* of a lighting circuit 5 to be prevented from being damaged by heat, whereby increased life can be obtained. In addition, composing the shell 24 particularly requiring mechanical strength and the heat-transferring member 25 particularly requiring thermal conductivity of separate parts allows the following. In a bulb-type fluorescent lamp having a configuration where a base 23 is integrated with a case 13, a heat-transferring member 25 can be selected from variations that vary in material, thickness or the like so that heat in a space formed in the case 13 can be absorbed efficiently by the heat-transferring member 25. As a result, while securing sufficient mechanical strength of a shell, the heat absorbed by the heat-transferring member 25 can be conducted efficiently to a shell 24.

In the respective embodiments described above, descriptions were directed to the cases where the heat-transferring members 11, 15*b*, and 25 made of metal were employed. The present invention is not restricted to those in the above cases. When a member composed of resin such as graphite, ceramic, or the like that have an excellent thermal conductivity is employed, the same effects as those of the above-described cases can be obtained.

Furthermore, in the respective embodiments described above, descriptions were directed to the cases where the respective heat-transferring members 11, 15*b*, and 25 covering an entire periphery of the space formed in each of the cases 2 and 13, were employed. However, when a member covering only a portion of the entire periphery of the space formed in each of the cases 2 and 13 is employed, the same effects as those of the above-described cases can be obtained.

Furthermore, in the respective embodiments described above, descriptions were directed to the cases where the shells 8, 15, and 24 made of metal were employed. However, when a shell is employed that is made of a composite conductive material with electrical conductivity and thermal conductivity, the same effects as those of the above-described cases can be obtained. The composite conductive material is made by combining a polymeric material such as polybutylene terephthalate (PBT), polyphenylene sulfide (PPS), a composition of PBT and styrene-acrylonitrile (AS) resin, or the like with materials such as carbon black, metallic fiber, carbon fiber, metal flakes, metallic coating glass beads, metallic coating glass fiber, or the like.

Furthermore, in the respective embodiments described above, descriptions were directed to the cases where the heat-transferring members 11, 15*b*, and 25 and the shells 8, 15, and 24 of the bases 7, 14, and 23 were thermally connected. However, when the heat-transferring members 11, 15*b*, and 25 and the eyelets 9 and 16 of the bases 7, 14, and 23 are thermally connected, the same effects as those of the above-described cases can be obtained.

Furthermore, although in the respective embodiments described above, descriptions were directed to the cases where a base of the E26 type (or a base having a shape that can be applied correspondingly to that of the E26 type) was used as the bases 7, 14, and 23, the present invention also can apply to the cases where a base of other types such as the E type or the B type are employed.

Moreover, although in the respective embodiments described above, descriptions were made using a bulb-type fluorescent lamp having a rated power of 13 W as an example, the present invention also can apply to a bulb-type fluorescent lamp having a different rated power, for example, 22 W, a high-pressure discharge lamp, or the like.

As described above, according to the present invention, there is provided a tubular light bulb that can prevent phosphor film and electronic parts of a lighting circuit from being damaged by heat, whereby an increased life can be obtained.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A tubular light bulb device, comprising:

an arc tube;

a lighting circuit for lighting the arc tube;

a case housing the lighting circuit and having a base at one end; and a heat-transferring member disposed in the case for conducting heat from a space formed in the case to the base.

2. The tubular light bulb device according to claim 1, wherein the heat-transferring member is connected to the base and comprises a member embedded in the case.

3. The tubular light bulb device according to claim 1, wherein at least a portion of the heat-transferring member is exposed to the space formed in the case.

4. The tubular light bulb device according to claim 1, wherein the heat-transferring member is connected to the base and provided on an inner face of the case.

5. The tubular light bulb device according to claim 1, wherein the heat-transferring member extends from a first end to a second end of the case.

6. The tubular light bulb device according to claim 1, wherein the heat-transferring member is connected to the base in such a manner that an end of the heat-transferring member is overlapped with an end of the base.

7. The tubular light bulb device according to claim 1, wherein the heat-transferring member is provided with through-holes.

8. The tubular light bulb device according to claim 1, wherein the heat-transferring member is electrically insulated from the base.

9. The tubular light bulb device according to claim 1, further comprising an electrically-insulating member comprising at least one selected from the group consisting of titanium oxide, alumina, silicon oxide, and fluorocarbon resin formed on a surface of the heat-transferring member.

10. The tubular light bulb device according to claim 1, wherein the heat-transferring member is integrated with a portion of the base.

11. The tubular light bulb device according to claim 1, wherein the heat-transferring member is formed of at least one material selected from the group consisting of metal, resin, and ceramic.

12. The tubular light bulb device according to claim 1, wherein the heat-transferring member is made of metal, and a portion thereof adjacent to a part in the lighting circuit that generates magnetism is cut away.

13. The tubular light bulb device according to claim 1, wherein the heat-transferring member is formed of a case integrated with a metal plate embedded in resin as a forming material.

14. The tubular light bulb device according to claim 13, wherein the metal plate embedded in the resin is provided, on a side of the base, with through-holes penetrating from inside to outside.

15. The tubular light bulb device according to claim 1, wherein the heat-transferring member is formed of a metal plate having a thickness in the range of 0.05 mm to 0.3 mm.

16. The tubular light bulb device according to claim 1, wherein a contact area between the heat-transferring member and the base is at least 300 $mm^2$.

* * * * *